US006994080B1

(12) United States Patent
Yoder

(10) Patent No.: US 6,994,080 B1
(45) Date of Patent: Feb. 7, 2006

(54) ARROW REST

(76) Inventor: Kevin L. Yoder, 309 Michelle La., Mt. Holly, NC (US) 28120

( * ) Notice: Subject to any disclaimer, the term of this patent is extended or adjusted under 35 U.S.C. 154(b) by 3 days.

(21) Appl. No.: 10/914,514

(22) Filed: Aug. 9, 2004

(51) Int. Cl.
*F41B 5/22* (2006.01)

(52) U.S. Cl. ..... 124/44.5

(58) Field of Classification Search ..... 124/24.1, 124/44.5
See application file for complete search history.

(56) References Cited

U.S. PATENT DOCUMENTS

| | | | | |
|---|---|---|---|---|
| 4,351,311 | A * | 9/1982 | Phares | 124/44.5 |
| 4,759,337 | A * | 7/1988 | Suski | 124/24.1 |
| 4,858,589 | A | 8/1989 | Chang | |
| 5,025,773 | A | 6/1991 | Hintze et al. | |
| 5,031,601 | A | 7/1991 | Gunter | |
| 5,042,450 | A | 8/1991 | Jacobson | |
| 5,161,515 | A | 11/1992 | Hammonds | |
| 5,245,980 | A | 9/1993 | Colvin | |
| 5,253,633 | A | 10/1993 | Sisko | |
| 5,261,383 | A | 11/1993 | Halamay | |
| 5,419,303 | A | 5/1995 | Stewart | |
| 5,447,284 | A | 9/1995 | Heinz | |
| 5,456,242 | A | 10/1995 | Ruholl | |
| 5,460,152 | A | 10/1995 | Specht | |
| 5,460,153 | A | 10/1995 | Huntt | |
| 5,462,041 | A | 10/1995 | Solecki | |
| 5,490,491 | A | 2/1996 | Troncoso | |
| 5,526,800 | A * | 6/1996 | Christian | 124/44.5 |
| 5,896,849 | A | 4/1999 | Branthwaite et al. | |
| RE38,096 | E | 4/2003 | Branthwaite et al. | |
| 6,557,541 | B2 | 5/2003 | Pinto, Jr. | |
| 6,561,175 | B1 | 5/2003 | Tidmore | |
| 6,725,851 | B1 | 4/2004 | Graf | |

* cited by examiner

*Primary Examiner*—John A. Ricci
(74) *Attorney, Agent, or Firm*—Adams Evans P.A.

(57) ABSTRACT

An arrow rest for guiding and supporting an arrow on an archery bow. The arrow rest includes a base, a plurality of spaced apart arrow supports, and a mounting bracket. Each of the arrow supports include a support shoe and a plurality of bristles. The support shoe is attached to the base. The bristles extend inwardly from the support shoe for supporting an arrow. The mounting bracket attaches the base to the archery bow.

17 Claims, 5 Drawing Sheets

ARROW REST

TECHNICAL FIELD AND BACKGROUND OF THE INVENTION

This invention relates to archery equipment and more particularly to an arrow rest for guiding and supporting an arrow on an archery bow.

Arrow rests are well known in the art. Arrow rests provide a support for an arrow prior to and during drawing of an archery bow to a shooting position. Arrow rests also provide a guide for the arrow to aid the arrow in reaching an intended target after it has been released from the bow string.

While almost every arrow rest is capable of providing a support and a guide for an arrow, there are several other functions that an arrow rest must address. Arrow rests must cause a minimal amount of frictional resistance to an arrow. Frictional resistance results in a loss of energy that would otherwise be transferred to the arrow, resulting in a loss of speed and accuracy. Arrow rests should also make minimal contact with the fletching or vanes of an arrow. Vanes are very important to proper arrow flight, and a damaged vane could have adverse effects on the speed and accuracy of the arrow. Additionally, hunters require the arrow rest to be quiet and allow them to draw a bow at various angles without the arrow falling off of the arrow rest. Thus, archery equipment manufacturers have attempted to provide an arrow rest that satisfies all of these requirements.

For Example, U.S. Pat. No. RE38,096 to Branthwaite et al. describes an arrow rest for use with an archery bow. The arrow rest uses an inverted coil brush having a disc-shaped structure. The coil brush includes a plurality of radially disposed, inwardly projecting bristles. The bristles form a central opening in the arrow rest wherein the arrow shaft is radially supported.

U.S. Pat. No. 6,725,851 to Graf describes an arrow rest frame with multiple supports. The frame includes first and second projections which define an aperture for radially supporting an arrow.

These invention each provide an arrow rest that is quiet and prevents the arrow from falling off of the rest when the bow is drawn at various angles. However, these rests make substantial contact with the vanes of the arrow. This contact increases the frictional loss created by the arrow rest and hinders the speed and accuracy of the arrow. The contact also reduces the life of the arrow's vanes, especially if helical vanes or feathers are used.

Accordingly, there is a need for an arrow rest that is quiet, prevents the arrow from falling off of the rest, and reduces the amount of contact between the vanes and arrow rest.

SUMMARY OF THE INVENTION

Therefore, it is an object of the invention to provide an arrow rest that supports an arrow on an archery bow.

It is another object of the invention to provide an arrow rest that prevents an arrow from falling of the arrow rest when the bow is drawn at various angles.

It is another object of the invention to provide an arrow rest that does not interfere with the arrow's flight path.

It is another object of the invention to provide an arrow rest that is quiet.

It is another object of the invention to provide an arrow rest that does not damage the arrow's vanes.

These and other objects of the present invention are achieved in the preferred embodiments disclosed below by providing an arrow rest for use with an archery bow. The arrow rest includes a base, a plurality of spaced-apart arrow supports, and a mounting bracket. Each of the arrow supports includes a support shoe attached to the base and a plurality of bristles extending inwardly from the support shoe for supporting an arrow. The mounting bracket attaches the base to the archery bow.

According to another preferred embodiment of the invention, the base is generally arcuate.

According to another preferred embodiment of the invention, the bristles are disposed on the support shoe in at least two longitudinal rows parallel to a radial centerline.

According to another preferred embodiment of the invention, a free end of each of the bristles are cut at an angle towards a center of the arrow support for allowing the bristles to conform to the cross-sectional shape of the arrow.

According to another preferred embodiment of the invention, the mounting bracket allows the base to be adjusted vertically and horizontally.

According to another preferred embodiment of the invention, the support shoe is attached to an inside surface of the base by at least one fastener.

According to another preferred embodiment of the invention, the base includes at least one slot positioned on each opposing side of the base for allowing the arrow supports to be moved along the base.

According to another preferred embodiment of the invention, the arrow supports form a triangular opening for supporting the arrow.

According to another preferred embodiment of the invention, the arrow supports radially support the arrow.

According to another preferred embodiment of the invention, an arrow rest for use with an archery bow, includes a generally arcuate base; a plurality of spaced-apart arrow supports attached to an inside surface of the base, wherein the arrow supports are positioned along the base to allow a vane of an arrow to pass between the arrow supports; and a mounting bracket. Each of the arrow supports includes a support shoe attached to the base and a plurality of bristles extending inwardly from the support shoe for supporting an arrow. The mounting bracket attaches the base to the archery bow, wherein the mounting bracket allows the base to be adjusted vertically and horizontally.

According to another preferred embodiment of the invention, an arrow rest for use with an archery bow, includes a generally arcuate, open-ended base with a pair of slots positioned on each opposing side of the base; a plurality of spaced-apart arrow supports for radially supporting an arrow, wherein at least one arrow support is attached to the slots on each opposing side of the base for allowing the at least one arrow support to be moved along the base; and a mounting bracket. Each of the arrow supports includes a support shoe for being attached to an inside surface of the base and a plurality of bristles extending inwardly from the support shoe for supporting the arrow, wherein the plurality of bristles are disposed on the support shoe in two longitudinal rows parallel to a radial center line. The mounting bracket attaches the base to the archery bow, wherein the mounting bracket allows the base to be adjusted vertically and horizontally.

According to another preferred embodiment of the invention, the base includes a pair of slots positioned on each opposing side of the base.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
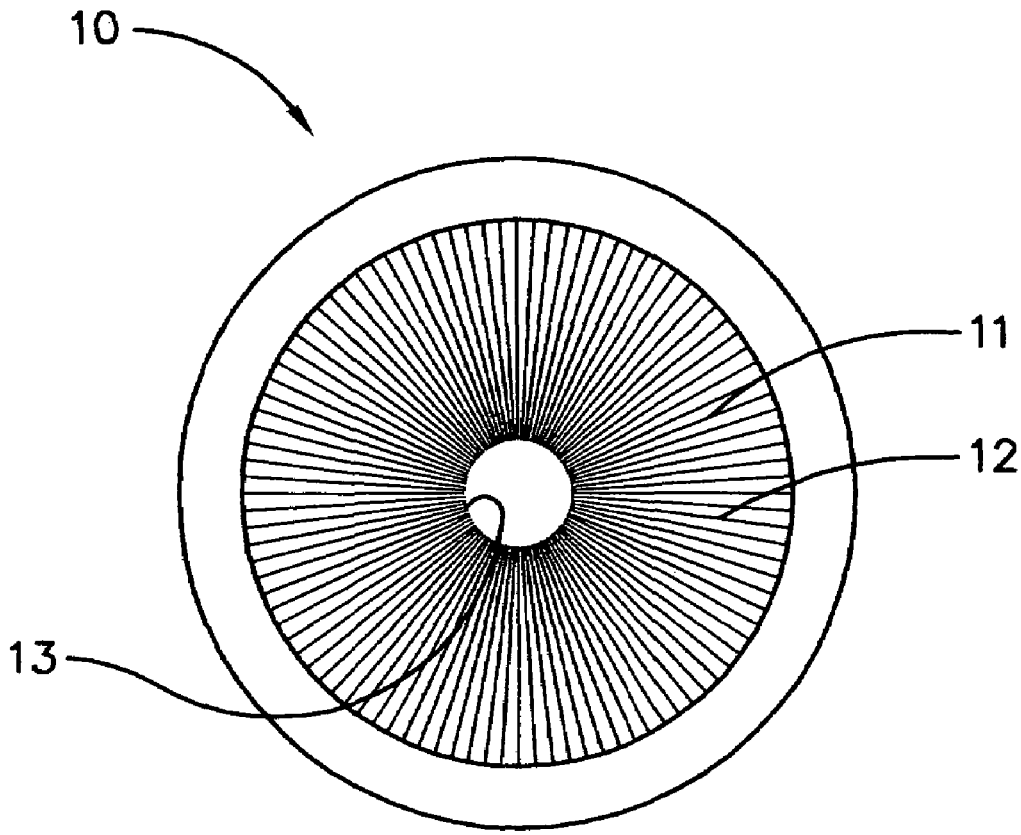
FIG. 1 PRIOR ART
FIG. 1 is an end view of a prior art arrow rest having a plurality of inwardly-extending bristles.
Figure 2:
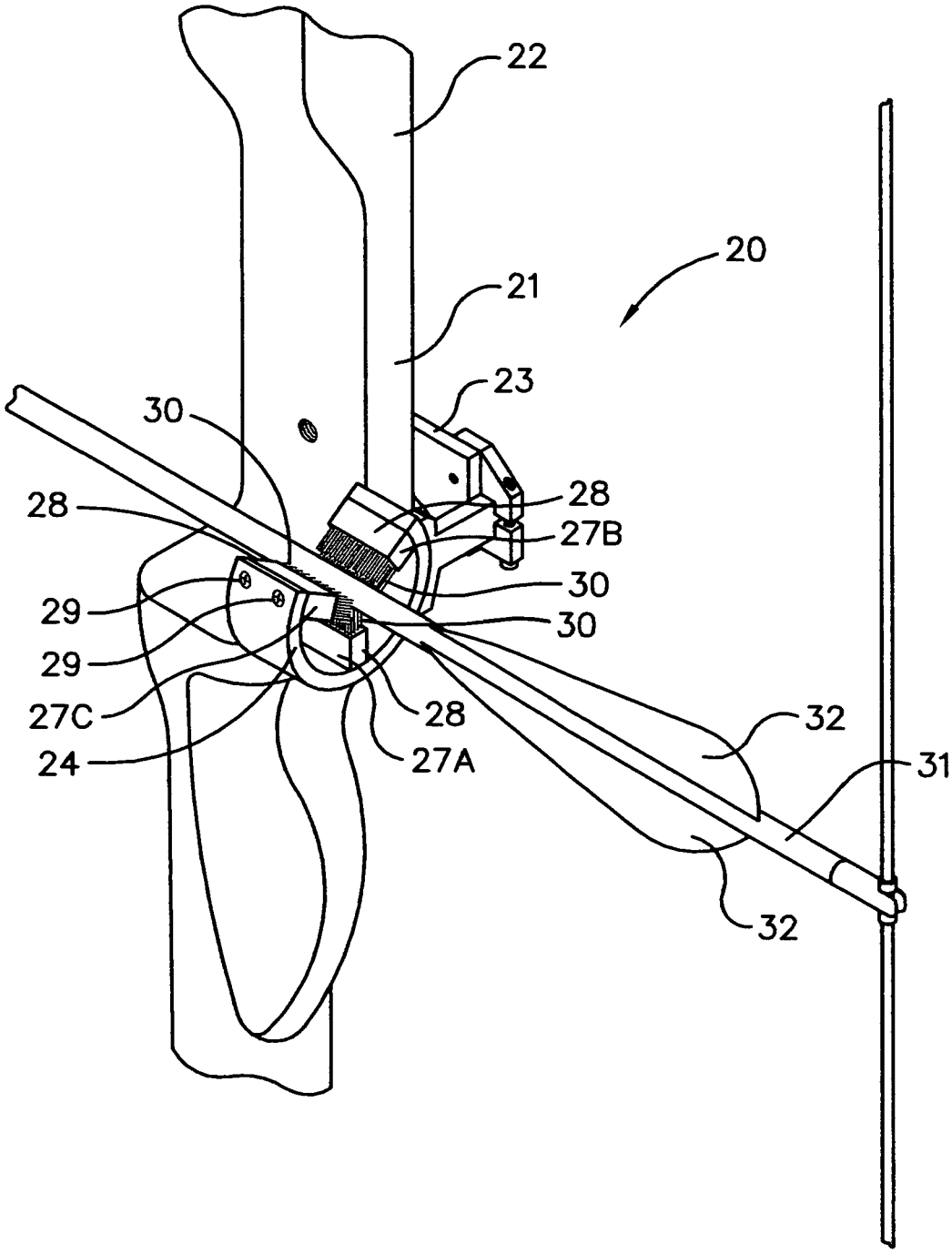
FIG. 2 is a perspective view of an archery bow with an arrow rest according to an embodiment of the invention.
Figure 3:
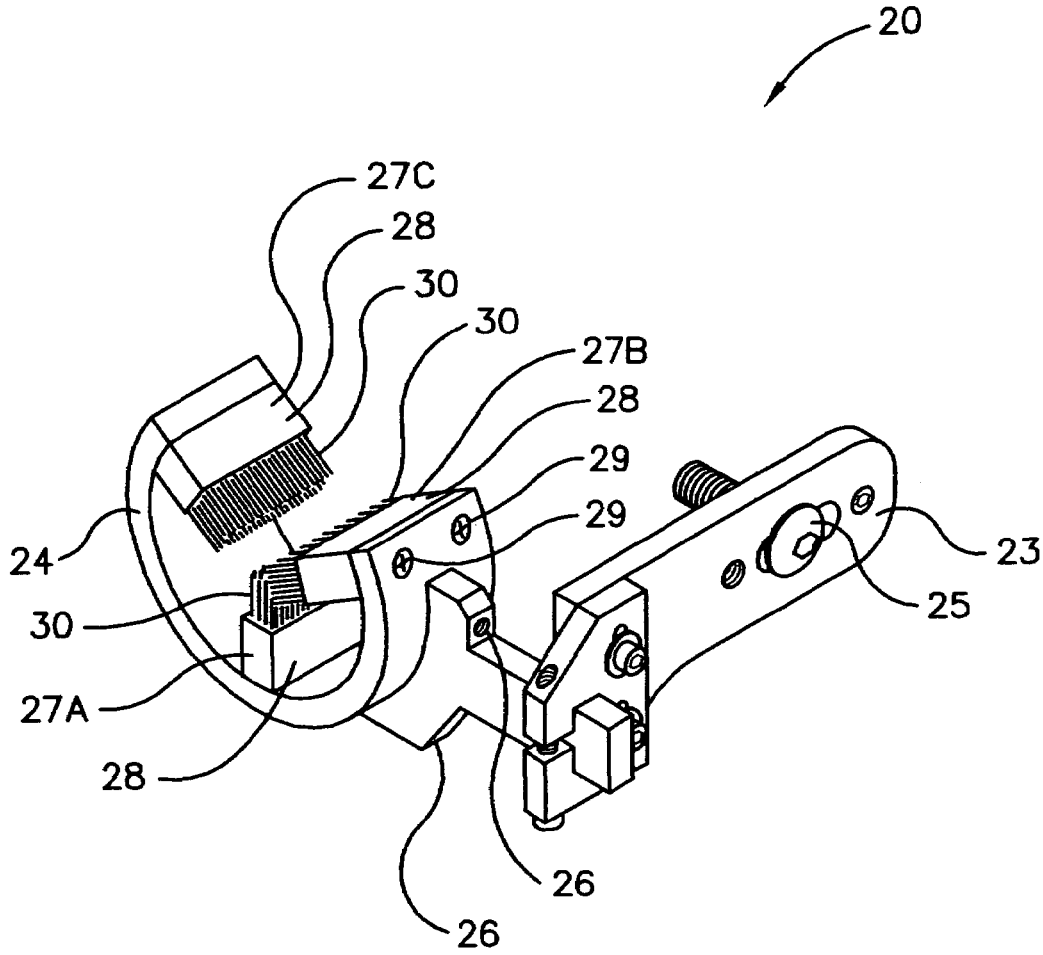
FIG. 3 is a perspective view of the arrow rest.

FIG. 1 illustrates a prior art arrow rest 10 for use with an archery bow. Arrow rest 10 has a generally disc-shaped inverted coil brush 11. The coil brush 11 includes a plurality of radially disposed, inwardly projected bristles 12 which define a circular central opening 13 for supporting an arrow.

The vanes of the arrow must pass through the coil brush 11 when the arrow is released from the archery bow, increasing the resistance produced by the arrow rest 10 and increasing the likelihood of damage to the vanes. Over a period of time, the damage caused by the coil brush 11 to the vanes will degrade the flight performance of the arrow result in the need to replace the vanes.

Referring now to FIGS. 2–5, an arrow rest of the present invention is shown generally at reference numeral 20. The arrow rest 20 is attached to a riser 21 of an archery bow 22 by a fastener 25 protruding through a mounting bracket 23 and into the riser 21. The mounting bracket 23 is a universal-type mounting bracket that allows the arrow rest 20 to be adjusted in a vertical and horizontal direction.

The arrow rest 20 comprises an open-ended generally arcuate base 24 attached to the mounting bracket 23 by fasteners 26 and three arrow supports 27A, 27B, and 27C positioned on an inside surface of the base 24. The open-ended base 24 provides approximately 240 degrees of support for the arrow supports 27A–27C. Each of the arrow supports 27A–27C has a support shoe 28 attached to the base 24 by fasteners 29. A plurality of inwardly-extending bristles 30 are disposed on the support shoe 28 for radially supporting an arrow 31.

Figure 4:
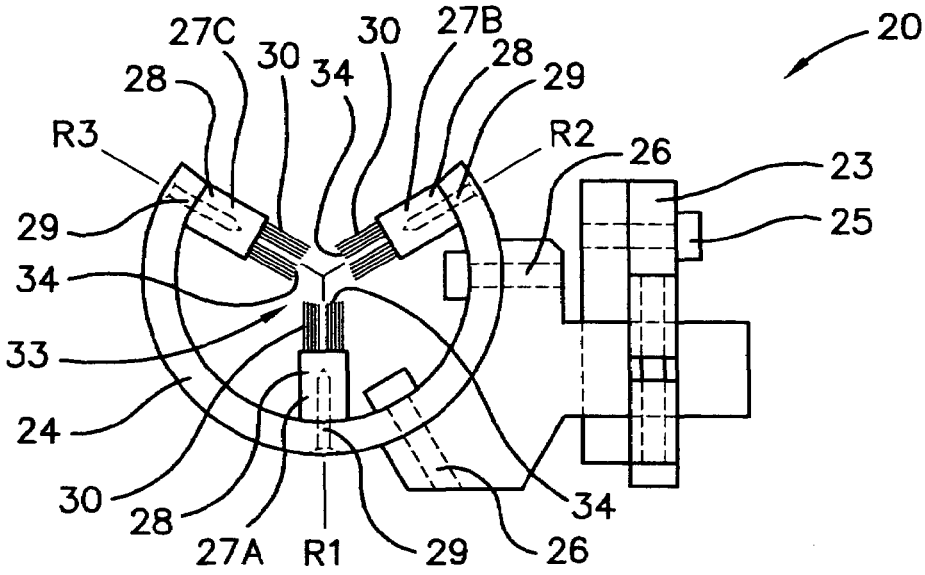
FIG. 4 is an end view of the arrow rest.
Figure 5:
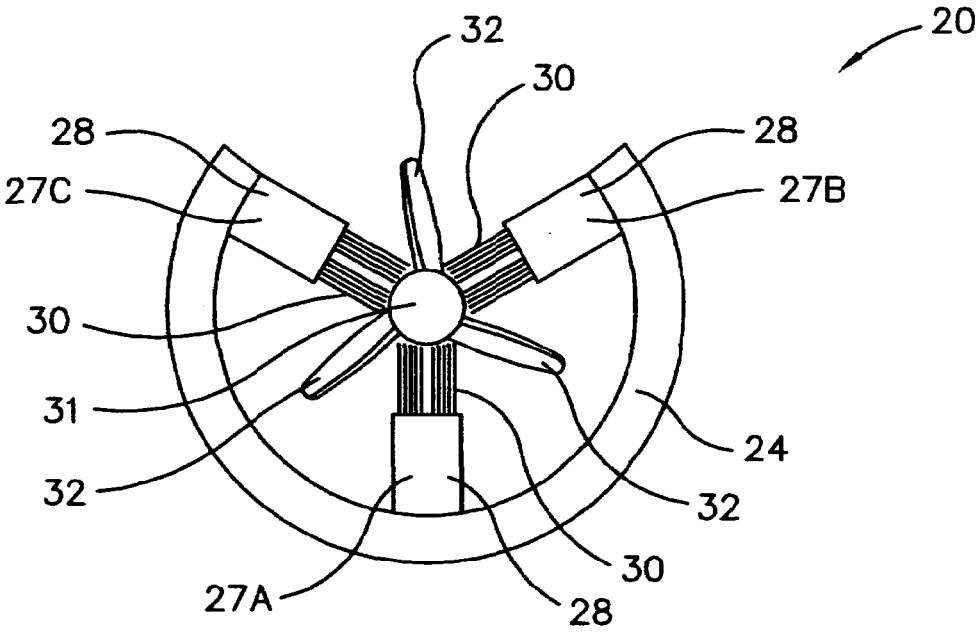
FIG. 5 shows an arrow supported by the arrow rest.

Referring to FIGS. 4 and 5, the arrow supports 27A–27C are positioned at intervals to allow vanes 32 of the arrow 31 to pass between the arrow supports 27A–27C without interference. As illustrated in FIG. 4, the arrow supports 27A–27C are positioned at 120 degree intervals. The bristles 30 are disposed on the support shoe 28 of the arrow supports 27A–27C in two longitudinal rows. Unlike the prior art arrow rest 10 illustrated in FIG. 1, the bristles 30 do not extend radially to a common center point to form a circular opening 13. On the contrary, the bristles 30 straddle a respective radial centerline (e.g. "R1", "R2", "R3") to define a triangular-shaped opening 33.

The bristles 30 are preferably fabricated from nylon or other suitable material of sufficient strength and resiliency to withstand repeated deflection by the arrow 31. The bristles 30 are trimmed along a free end 34 of each of the bristles 30 at an angle towards a center of the arrow support 20 to give the bristles 30 a slight curvature to match the circular cross-sectional shape of the arrow 31.

The arrow 31 rests on the arrow support 27A while arrow supports 27B and 27C make minimal contact with the arrow 31 to prevent the arrow 31 from falling off of the arrow rest 20 when the archery bow 22 is drawn at different angles.

Figure 6:
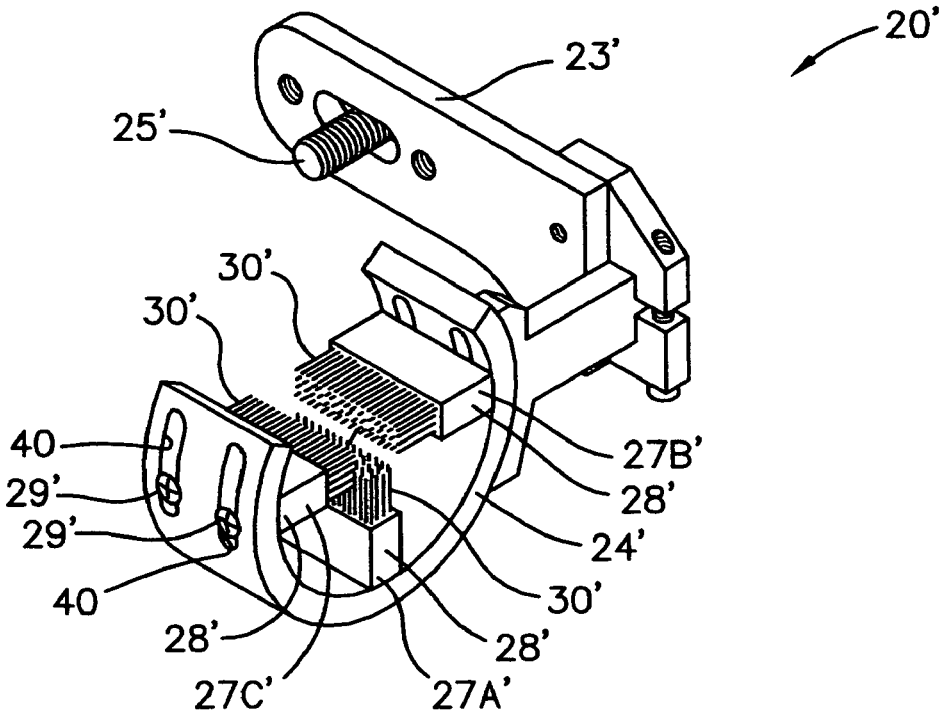
FIG. 6 is a perspective of an arrow rest according to another embodiment of the invention.
Figure 7:
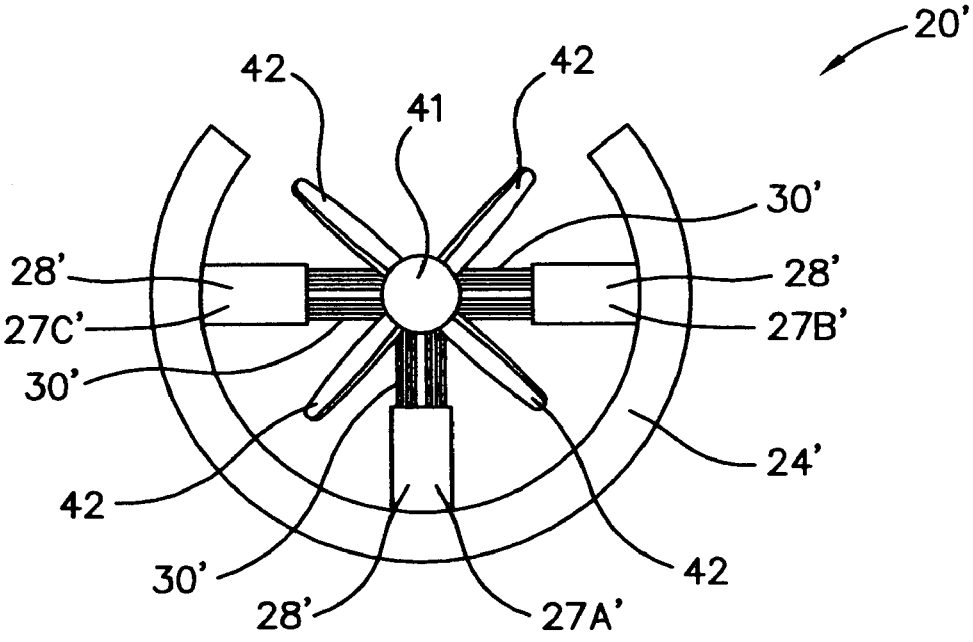
FIG. 7 shows an arrow supported by the arrow rest of FIG. 6.

As shown in FIGS. 6 and 7, in which prime reference numerals indicate like elements to those in FIGS. 2–5, an alternative arrow rest 20' may include a pair of parallel longitudinal slots 40 positioned on each opposing side of the base 24'. Arrow supports 27A', 27B', and 27C', each having a support shoe 28' and a plurality of inwardly-extending bristles 30', are attached to the base 24' by fasteners 29'. Arrow supports 27B' and 27C' are attached to the base 24' by fasteners 29' protruding through the slots 40 of the base 24' to allow the arrow supports 27B' and 27C' to be moved along the base 24'.

The slots 40 allow the arrow supports 27B' and 27C' to be adjusted in relation to arrow support 27A' to create spacing intervals of about 75 degrees to about 120 degrees to allow arrows having various vane arrangements to be used in the arrow rest 20'. As illustrated in FIG. 7, an arrow 41 having four vanes 42 is supported by the arrow rest 20'. The arrow supports 27B' and 27C' are each positioned at about 90 degrees from arrow support 27A' to allow the vanes 42 to be positioned between the arrow supports 27A'–27C'. For an arrow having three vanes, arrow supports 27B' and 27C' would each be positioned at about 120 degrees from arrow support 27A', similar to arrow rest 20 shown in FIG. 5, to allow the vanes to be positioned between the arrow supports 27A'–27C'.

An arrow rest is described above. Various details of the invention may be changed without departing from its scope. Furthermore, the foregoing description of the preferred embodiments of the invention and the best mode for practicing the invention are provided for the purpose of illustration only and not for the purpose of limitation, the invention being identified in the claims.

I claim:

1. An arrow rest for use with an archery bow, comprising:

(a) a generally arcuate base;

(b) a plurality of spaced-apart arrow supports, each of the arrow supports comprising:

(i) a support shoe attached to the base; and (ii) a plurality of bristles extending inwardly from the support shoe for supporting an arrow; and (c) a mounting bracket for mounting the base to the archery bow.

2. The arrow rest according to claim 1, wherein the bristles are disposed on the support shoe in at least two longitudinal rows parallel to a radial centerline.

3. The arrow rest according to claim 1, wherein a free end of each of the bristles are cut at an angle towards a center of the arrow support for allowing the bristles to conform to the cross-sectional shape of the arrow.

4. The arrow rest according to claim 1, wherein the mounting bracket allows the base to be adjusted vertically and horizontally.

5. The arrow rest according to claim 1, wherein the support shoe is attached to an inside surface of the base by at least one fastener.

6. The arrow rest according to claim 1, wherein the base includes at least one slot positioned on each opposing side of the base for allowing the arrow supports to be moved along the base.

7. The arrow rest according to claim 1, wherein the arrow supports form a triangular opening for supporting the arrow.

8. The arrow rest according to claim 1, wherein the arrow supports radially support the arrow.

9. An arrow rest for use with an archery bow, comprising:

(a) a generally arcuate base;

(b) a plurality of spaced-apart arrow supports attached to an inside surface of the base, wherein the arrow supports are positioned along the base to allow a vane of an arrow to pass between the arrow supports, each of the arrow supports comprising:

(i) a support shoe attached to the base; and (ii) a plurality of bristles extending inwardly from the support shoe for supporting the arrow; and (c) a mounting bracket for mounting the base to the archery bow, wherein the mounting bracket allows the base to be adjusted vertically and horizontally.

10. The arrow rest according to claim 9, wherein the bristles are disposed on the support shoe in at least two longitudinal rows parallel to a radial centerline.

11. The arrow rest according to claim 9, wherein a free end of each of the bristles are cut at an angle towards a center of the arrow support for allowing the bristles to conform to the cross-sectional shape of the arrow.

12. The arrow rest according to claim 9, wherein the base includes at least one slot positioned on each opposing side of the base for allowing the arrow supports to be moved along the base.

13. The arrow rest according to claim 9, wherein the arrow supports radially support the arrow.

14. An arrow rest for use with an archery bow, comprising:

(a) a generally circular, open-ended base with at least one slot positioned on each opposing side of the base;

(b) a plurality of spaced-apart arrow supports for radially supporting an arrow, wherein at least one arrow support is attached to the slots on each opposing side of the base for allowing the at least one arrow support to be moved along the base, each of the arrow supports comprising:

(i) a support shoe attached to an inside surface of the base; and (ii) a plurality of bristles extending inwardly from the support shoe for supporting the arrow, wherein the plurality of bristles are disposed on the support shoe in at least two longitudinal rows parallel to a radial center line; and (c) a mounting bracket for mounting the base to the archery bow, wherein the mounting bracket allows the base to be adjusted vertically and horizontally.

15. The arrow rest according to claim 14, wherein a free end of each of the bristles are cut at an angle towards a center of the arrow support for allowing the bristles to conform to the cross-sectional shape of the arrow.

16. The arrow rest according to claim 14, wherein the base includes a pair of slots positioned on each opposing side of the base.

17. The arrow rest according to claim 14, wherein the support shoe is attached to an inside surface of the base by at least one fastener.

* * * * *